US007108080B2

(12) United States Patent
Tessari et al.

(10) Patent No.: US 7,108,080 B2
(45) Date of Patent: Sep. 19, 2006

(54) METHOD AND APPARATUS FOR DRILLING A BOREHOLE WITH A BOREHOLE LINER

(75) Inventors: Robert M. Tessari, Calgary (CA); Bruce D. Houtchens, Spring, TX (US)

(73) Assignee: Tesco Corporation, Calgary (CA)

( * ) Notice: Subject to any disclaimer, the term of this patent is extended or adjusted under 35 U.S.C. 154(b) by 180 days.

(21) Appl. No.: 10/799,217

(22) Filed: Mar. 12, 2004

(65) Prior Publication Data

US 2004/0256157 A1 Dec. 23, 2004

(30) Foreign Application Priority Data

Mar. 13, 2003 (CA) ..... 2422150
Mar. 31, 2003 (CA) ..... 2424337
Apr. 17, 2003 (CA) ..... 2429076

(51) Int. Cl.
*E21B 7/26* (2006.01)

(52) U.S. Cl. ..... 175/21; 175/38; 175/72; 175/234; 175/318; 175/324

(58) Field of Classification Search ..... None
See application file for complete search history.

(56) References Cited

U.S. PATENT DOCUMENTS 2,946,565 A 7/1960 Williams
3,025,919 A 3/1962 Angel et al.
3,823,788 A 7/1974 Garrison et al.
3,997,010 A 12/1976 Rilling
4,223,747 A 9/1980 Marais
4,312,415 A 1/1982 Franks, Jr.
5,472,057 A 12/1995 Winfree
6,196,336 B1 3/2001 Fincher et al.
6,263,969 B1 7/2001 Stoesz et al.
6,397,946 B1 6/2002 Vail, III
6,679,336 B1 * 1/2004 Musselwhite et al. ..... 166/386
6,722,454 B1 4/2004 Mocivnik et al.
2002/0170749 A1 11/2002 Hoyer et al.

* cited by examiner

*Primary Examiner*—Zakiya W. Bates
(74) *Attorney, Agent, or Firm*—Colin P. Cahoon; William S. Wang; Carstens & Cahoon, LLP

(57) ABSTRACT

A method for drilling a borehole includes; providing a drill string of drill pipe including a center bore, a distal end, a bit assembly at the distal end; hanging a liner from the drill string, thereby forming an annular space between the drill string and the liner and with the bit assembly extending from a lower end of the liner; positioning the drill string with the liner attached thereto in a borehole such that a second annular space is formed between the liner and the borehole wall; operating the bit assembly to proceed with drilling the borehole; and circulating drilling fluid down through the center bore of the drill string out through the bit assembly and down through the second annular space between the liner and the borehole wall, the drilling fluid returning up through the annular space between the drill string and the liner.

32 Claims, 10 Drawing Sheets

METHOD AND APPARATUS FOR DRILLING A BOREHOLE WITH A BOREHOLE LINER

FIELD OF THE INVENTION

The invention relates to drilling well bores and in particular a method and an apparatus for drilling a wellbore using a borehole liner.

BACKGROUND OF THE INVENTION

A drilling liner can be carried along behind the pilot bit to line a borehole while it is being drilled. Previously drilling fluid has been circulated down through a drill pipe, through the pilot bit and up the outer annulus between the drilling liner and the borehole wall. In these previous methods, drilling with a liner was often difficult. Pressure exerted on the formation due to a combination of the fluid density and the frictional pressure losses in the small annulus between the liner and the borehole/casing wall may induce fractures in the formation and cause lost circulation.

Alternately, in other methods, the drilling fluid is circulated down through the drill pipe and forced up through the liner by sealing between the liner shoe and the borehole wall. This requires the use of an open hole packer, which may not be desirable.

SUMMARY OF THE INVENTION

In accordance with one aspect of the present invention, there is provided a borehole drilling apparatus comprising: a drill string including a center bore and a distal end; a bit assembly at the drill string's distal end; a ported sub mounted on the drill string, the ported sub including an upper surface, a lower surface, a bore extending from the upper surface to the lower surface to which the drill string is connected, an axially extending port for providing fluid communication between the lower surface and the upper surface separate from fluid communication with the bore and a lateral port for providing fluid communication between the drill string center bore and an outer surface of the sub between the upper surface and the lower surface, the lateral port being substantially isolated against fluid communication with the axially extending port during operation; and a liner engaging surface encircling the lower surface, the liner engaging surface formed to releasably secure a borehole liner such that the drill string extends through the borehole liner with the bit assembly extending beyond a liner shoe of the liner with an opening between the drill string and the liner.

In accordance with another broad aspect, there is provided a method for drilling a borehole comprising: providing a drill string including a center bore, a distal end, a bit assembly at the distal end; hanging a liner from the drill string, thereby forming an annular space between the drill string and the liner and with the bit assembly extending from a lower end of the liner; positioning the drill string with the liner attached thereto in a borehole such that a second annular space is formed between the liner and the borehole wall; operating the bit assembly to proceed with drilling the borehole; and circulating drilling fluid down through the center bore of the drill string out through the bit assembly and down through the second annular space between the liner and the borehole wall, the drilling fluid returning up through the annular space between the drill string and the liner.

In accordance with another broad aspect of the present invention, there is provided an apparatus for drilling a borehole defined by a borehole wall, the apparatus comprising: a drill string including a center bore and a distal end; a bit assembly at the drill string's distal end; a liner including an upper end and an inner bore and the liner being arranged with the drill string extending through the liner inner bore; a ported sub mounted between the drill string and the liner to support the liner on the drill string, the ported sub including an upper surface, a lower surface about which the liner is connected, a bore extending from the upper surface to the lower surface through which the drill string is connected to the ported sub, an axially extending port for providing fluid communication between the liner inner bore and an upper opening to the upper surface of the sub, a lateral bore providing fluid communication between the drill string center bore and an outer surface of the sub between the upper surface and the lower surface, the lateral port being substantially isolated against fluid communication with the axially extending port during operation; and a seal adjacent the upper end of the liner and selected to seal against fluid flow upwardly about the liner upper end from an annulus formed between the liner and the borehole wall.

DETAILED DESCRIPTION OF VARIOUS EMBODIMENTS

Figure 1:
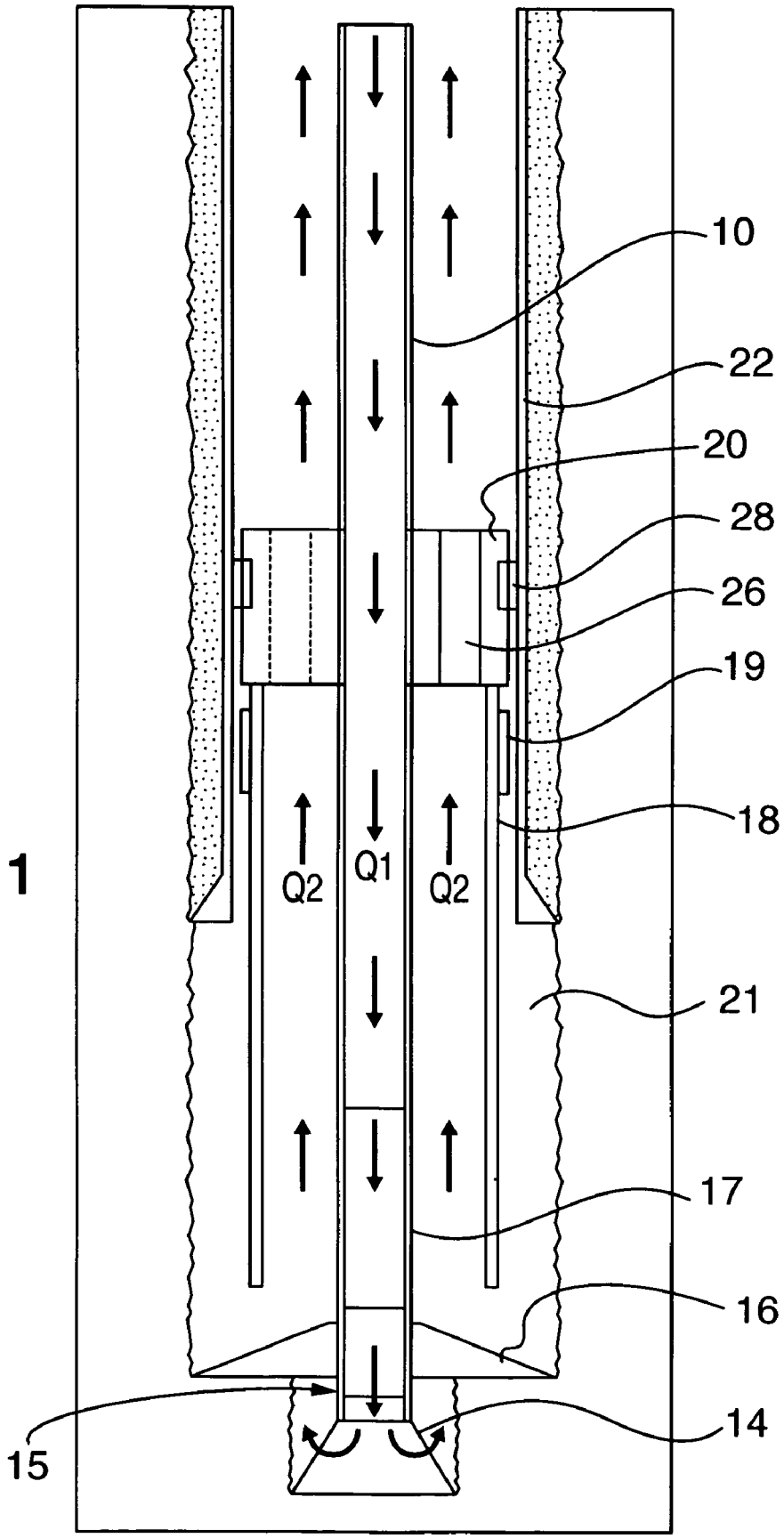
FIG. 1 is a schematic sectional view along a wellbore including a drilling system including a drilling liner and showing a method according to the present invention.

Drilling with a liner can be accomplished by drilling the liner in place using a drill string 10 formed of, for example, drill pipe or coiled tubing. Drill string 10 may extend from surface to the bottom 12 of the hole. Drill string 10 includes a center bore 13 and can include a bottom hole assembly 17 and a bit assembly 15 for drilling a borehole sized to accommodate passage therethrough of the liner. Drilling assembly 15 may include, for example, a pilot bit 14 and an underreamer 16 (as shown), a bicenter bit, a pilot bit and cutting shoe, etc. As will be appreciated, the bit assembly may be driven by various means such as for example a mud motor in the bottom hole assembly. A liner 18 may be hung onto drill string 10 by a ported sub 20. Ported sub 20 may be mounted on the drill string, for example about a drill string tubular member or the drill string can be connected thereto, as by threaded connection. Ported sub 20 may include a liner engaging surface for releasably engaging the liner at its up hole end. The surface may encircle the lower end of the sub so that the sub fits in or over the upper end of the liner. The sub may fit sealing against the liner to limit fluid flow therebetween. The liner may be engaged by the sub such that it is hung with an annulus formed between the drill string and the liner, while the lower end of the liner is open about the drill string or ported to allow fluid flow into the drill string/liner annulus.

A liner hanger 19 is provided to support liner 18 within casing liner 22 or against the borehole wall, when it is desired to set the liner.

Ported sub 20 includes ports 26 through which drilling fluid can pass axially through the wellbore between the liner inner bore and the upper surface of the sub, while returning to surface. Ports 26 may be termed axially extending, wherein they may or may not be parallel to the center line of the sub, with reference to its position in the borehole, but permit fluids to pass substantially axially through the well bore. Ports 26 may be sized with consideration as to the volume of drilling fluid that is to be circulated and with consideration as to the size of cuttings that must pass therethrough.

Sub 20 carries a seal 28 such as a packer, a narrow gap seal or swab cups so that fluid is prevented from passing upwardly therepast, thereby substantially preventing drilling fluid from passing out of the annulus about the liner. In one embodiment, the seal may alternately be carried about the upper end of the liner. The seal may be selected with consideration as to the borehole conditions to be encountered. For example, where the borehole is lined with a casing, the seal may be selected to seal against the casing wall.

As drilling commences, fluid in the wellbore tends to be trapped in the annulus 21 about the liner. Drilling fluid provided from surface through drill string 10 flows through the inside (Q1) of drill string 10 and out through the pilot bit. Due to the action of seal 28, fluid trapped in annulus 21 creates a fluid lock forcing drilling fluid to return (Q2) up through the annulus between drill string 10 and liner 18. Fluid passes through ports 26 through sub 20 and returns to surface through the annulus between the casing liner 22 and the drill string.

Figure 2:
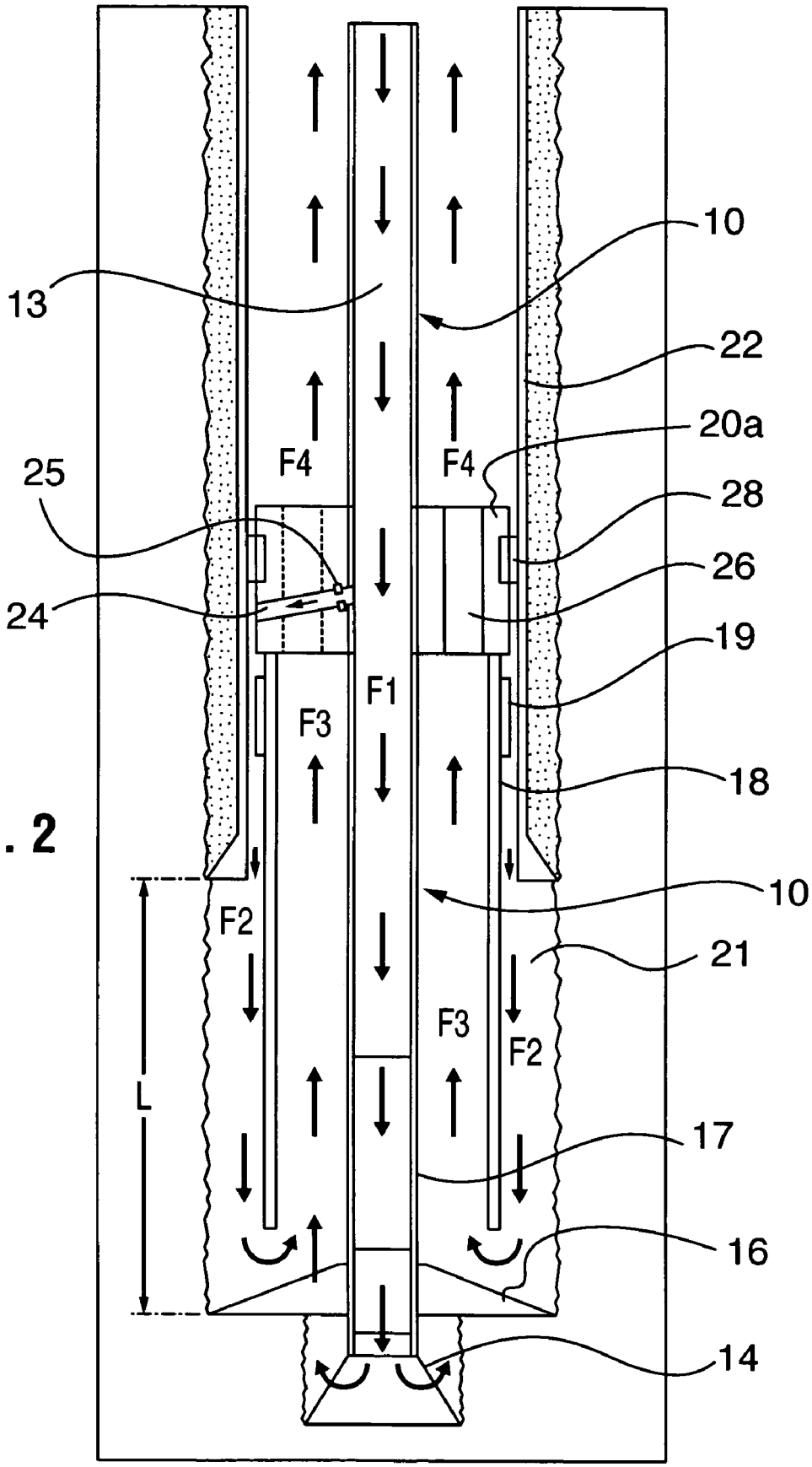
FIG. 2 is a schematic sectional view along a wellbore including another drilling system including a drilling liner and showing another method according to the present invention.

Referring to FIG. 2, there is shown another apparatus and method according to the present invention. Drill string 10 extends from surface to the bottom 12 of the hole and can include a bit assembly including, for example, a pilot bit 14 and an under reamer 16 driven and controlled by a bottom hole assembly 17 which may include, for example, a mud motor, MWD, LWD, etc., as desired.

Liner 18 is hung onto drill string 10 by a ported sub 20*a* connected therebetween. Liner 18 carries a liner hanger 19 for wedging the liner in position in the borehole.

As drilling commences, drilling fluid, initially provided through drill string 10, may be split to both (i) flow F1 down through the inside of drill string 10 and (ii) flow F2 down through the annulus about the outside of liner 18. Fluid then returns F3 up through the annulus between drill string 10 and liner 18, passes through ported sub 20*a* and returns to surface through the annulus F4 between the borehole wall or casing liner 22 and the drill string. The flow F1 provides that there is enough fluid to drive and lubricate pilot bit 14 and under reamer 16 while flow F2 acts against a flow of drilling fluid up the annulus between the liner and the borehole. Flow F2 may force all drilling fluid to pass up between the liner and the drill string. It has been found that flow through the annular space between liner 18 and drill string 10 causes less pressure loss than drilling fluid flow through the annular space between the liner and the borehole wall.

Ported sub 20*a* can include at least one lateral port 24 through which the fluid flow is split. Port 24 allows fluid to be diverted from the drill string inner bore to the annular space about the liner and may, therefore, open between drill string center bore 13 and the outer surface of liner 18, as shown, or the outer surface of the ported sub where it extends above the liner.

Flow F2 through port 24 may be controlled or restricted so that only a portion of the flow passes through that port with the remainder continuing down F1 through center bore 13 to the pilot bit. In one embodiment, a flow restrictor 25 can be installed in port 24 to provide resistance to fluid flow through the port.

Ported sub 20*a* also includes at least one port 26 through which flow F3 can pass. Ports 26 may be sized to permit cuttings to pass.

Ported sub 20*a* carries a seal 28 such as a packer or swab cups so that fluid is substantially prevented from passing upwardly from the annulus about the liner hanger and substantially prevented from communication between ports 24 and 26, thereby permitting fluid circulation to be controlled about the liner hanger.

In one embodiment, the drilling may be conducted through a borehole liner, such as a casing liner 22 that may already be cemented in the hole. The drilling may proceed using the above-noted circulation until the liner reaches a casing point, which is a point at which it is desired to set the liner in the borehole. The liner can be any length L in order to achieve a selected extension beyond a lower end 30 of the installed casing.

When the liner reaches casing point, the liner can be hung in the casing string, for example adjacent lower end 30, by actuation of liner hanger 19. Ported sub 20*a* and drill string 10, with attached pilot bit 14 and under reamer 16, may then be disconnected from the liner and retrieved through the liner and pulled from the well bore. The under reamer, when expanded, cuts a borehole greater than the outer diameter of the liner, but can be collapsed to be withdrawn through the liner.

Thereafter, if desired, the drill string can be reintroduced to the liner for cementing through the drill string. In one embodiment, it may be desirable that the drill string and ported sub 20*a* be removable from the liner at selected times during the drilling process, for example, when it is necessary to replace or repair a bit, under reamer or bottom hole assembly component. In such an embodiment, the ported sub 20*a* may be reconnectable to the liner and the liner hanger may be reversibly drivable to repeatedly engage, and release from engagement with, the casing.

Figure 3:
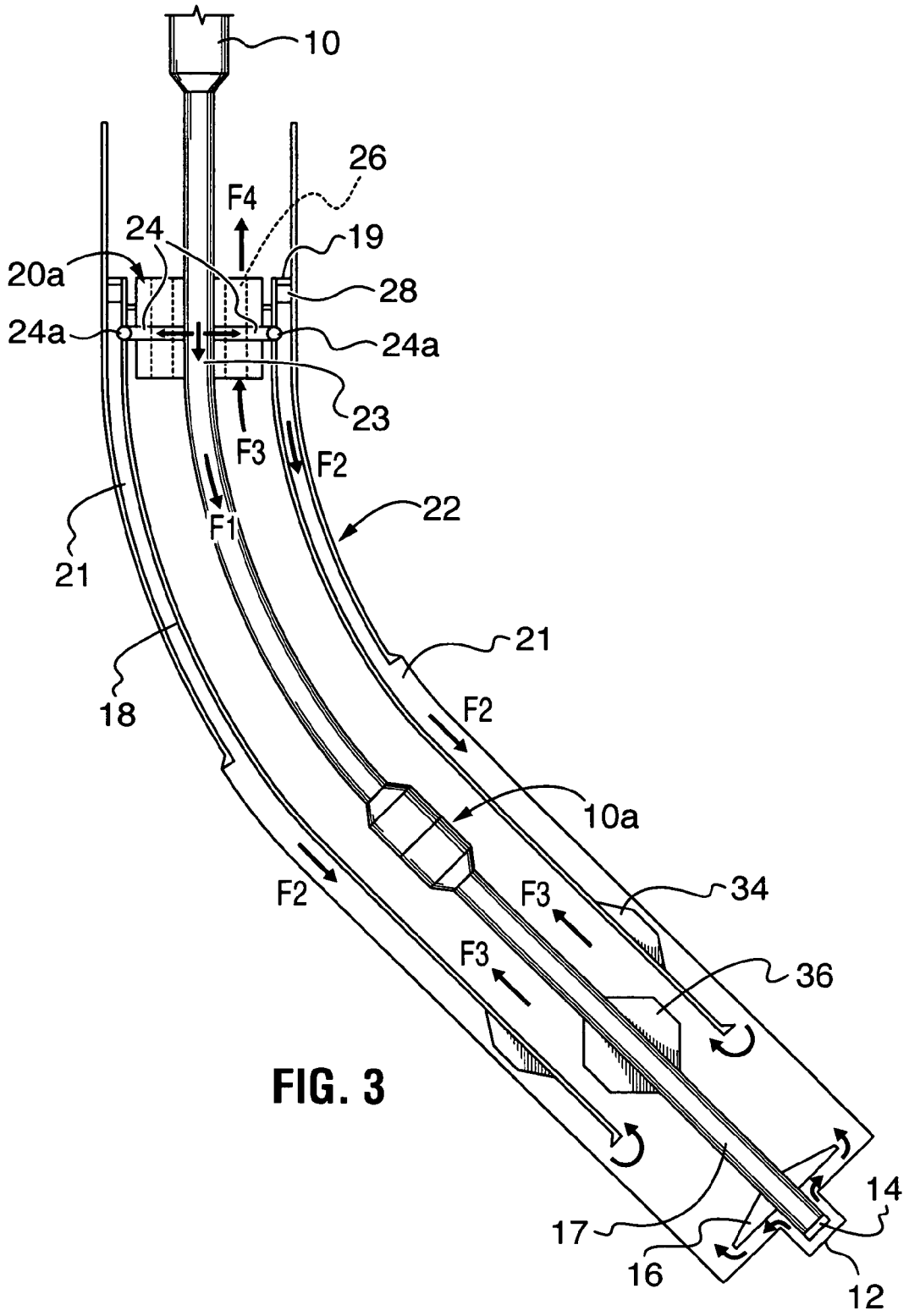
FIG. 3 is a schematic sectional view along a wellbore showing another drilling apparatus and method according to the present invention.

Referring to FIG. 3, there is shown another drilling assembly and method. A liner 18 can be drilled in place using a drill string 10 that may be, for example, formed of drill pipe. Drill string 10 extends from surface towards the bottom 12 of the hole and can include drilling tools including, for example, a pilot bit 14, an under reamer 16 and a bottom hole assembly 17 including a mud motor, MWD and LWD.

The drill pipe joints 10*a* may have a selected outer diameter so that there is a clearance between the inner diameter of the liner and the outer diameter of the drill pipe joints. Such a clearance may be selected to permit passage of drill cuttings and drilling fluid from a drilling operation.

A ported sub 20*a* may be provided including a bore 23 from its upper surface to its lower surface. Drill string 10 can be threadedly connected into bore 23 such that the bore provides communication to the drill string inner bore above and below the sub. Sub 20*a* may include ports 24 open to and extending from bore 23 and ports 26 extending substantially parallel to, but not in communication with, bore 23.

Liner 18 may be hung onto drill string 10 by the ported sub 20*a*. In so doing, ports 24 may be aligned with ports 24*a* through the liner so that a passage may be opened from bore 23, that is in communication with the drill string center bore, to the outer surface of liner 18. As such, a portion of any drilling fluid pumped through drill string can be e jetted through ports 24 and 24*a* into annulus 21.

Ported sub 20*a* also includes ports 26 through which drilling fluid can pass upwardly out of the liner inner bore. Ports 26 are sized to permit cuttings to pass. Ports 26 are not in fluid communication with ports 24.

Liner 18 carries a seal 28 such as a packer or swab cups so that fluid is prevented from communicating between ports 24, 26 through the annulus about the liner, thereby permitting the circulation to be controlled about the liner. Liner 18 also carries a liner hanger 19 for wedging between the liner and the casing 22 when setting the liner in the bore hole.

Stabilizers can be installed to control positioning of the liner and the drill string within the assembly. For example, one or more stabilizers/centralizers 34 may be installed about the liner and/or one or more stabilizers/centralizers 36 may be installed between the drill string and the liner. Of course, these stabilizers/centralizers may be formed to permit fluid flow therepast. Stabilizer/centralizer 36 also permits the passage of drill cuttings. In one embodiment, stabilizer/centralizer 36 may be fluted or ported to permit passage of drill cuttings and fluid.

As drilling commences using the embodiment of FIG. 3, the drilling fluid is initially provided from surface through drill string 10 and may be split at sub 20*a* to flow down both (i) through the inside (F1) of drill string 10 and (ii) through ports 24, 24*a* into the annulus 21 (F2) about the outside of liner 18. Fluid then returns F3 up through the annulus between drill string 10 and liner 18. Fluid passes through ports 26 of sub 20*a* and returns to surface through the annulus F4 between casing liner 22 and the drill string. Flow F2 need only be sufficient to force return flow up between the liner and the drill string, rather than between the borehole wall and the liner.

Figure 4:
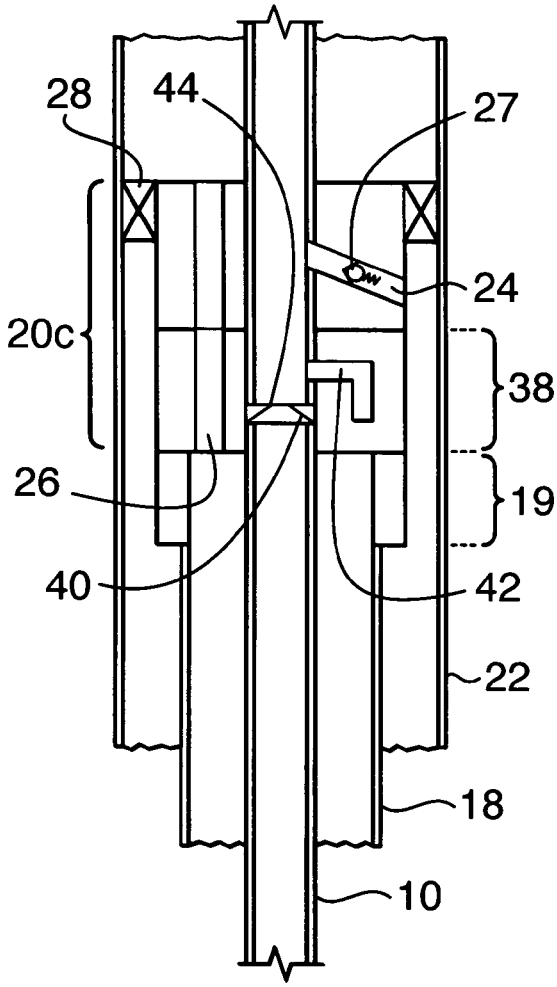
FIG. 4 is a schematic sectional view along a wellbore showing another drilling apparatus and method according to the present invention.

In another embodiment shown in FIG. 4, a ported sub 20*c* may include a setting tool component 38 to drive the setting of liner hanger 19. In such an embodiment, the ported sub is positioned between liner 18 and drill string 10. Ported sub 20*c* accommodates passage therethrough of drill string 10. Ported sub 20*c* includes at least one port 26 formed to permit fluid communication between the inner bore of liner 18 and an opening on the upper side of a seal 28 about the sub. Drill string 10 and port 26 may pass through various components of sub 20*c* in this embodiment. Sub 20*c* may also, if desired, include a port 24, possibly including a check valve 27 or restriction, for establishing a reverse circulation down the annulus about liner 18.

Setting tool component 38 provides one option for setting liner hanger 19. In the illustrated embodiment, setting tool component 38 may be hydraulically operable by selection of fluid pressures in the drill string. For example, as illustrated, a valve 40 may be positioned in drill string and a fluid passage 42 may be provided in component 38 up hole from valve 40 for communicating fluid to the liner hanger. In particular, valve 40 may include a seat 44 for accepting and creating a seal with a ball 46 (FIG. 5) launchable from surface when it is desired to generate fluid pressures suitable for operation of the setting tool component. Such generated fluid pressures may be communicated to the liner hanger through passage 42.

In operation of the embodiment just described, the assembly may be employed for drilling when drill string 10 is open. Drilling fluid may be circulated downhole with a portion passing though port 24 and down through annulus 21 about liner 18 and the remaining fluid flowing through the drill string and past valve 40 and to the bit (not shown). The pressure of the drilling fluid flows cause drilling fluid to be circulated back up through the annulus between liner 18 and drill string 10, through sub 20*c* and back to surface.

Figure 5:
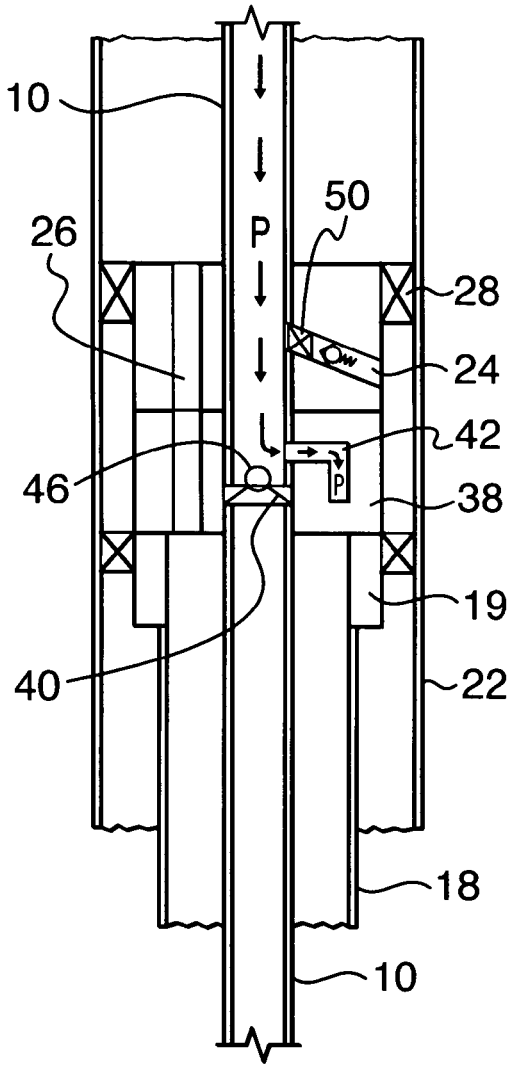
FIG. 5 is a view showing a method that may follow from that of FIG. 4.

With reference to FIG. 5, when it is desired to set the liner in the borehole, for example against casing 22, a ball 46 can be launched, which is sized to pass through drill string 10 and seat in valve 40. The drill string can then be pressured up P to a desired level to actuate component 38 to set liner hanger 19. Passage 42 allows for communication of this fluid pressure to the liner hanger.

In an embodiment including a component 38 as described, it may be useful to provide a valve 50 or another mechanism for closing port 24, where it is included in sub 20*c* so that generation of actuation pressure is not jeopardized by release through port 24. In addition or alternately, it may be useful to provide a valve or other mechanism in passage 42 which may be selectively openable so that the liner hanger mechanism is not affected by fluid during run in or drilling. In such an embodiment, valve 50 is closed and the valve in passage 42 is opened, before seeking to set the liner hanger by application of fluid pressure.

Figure 6:
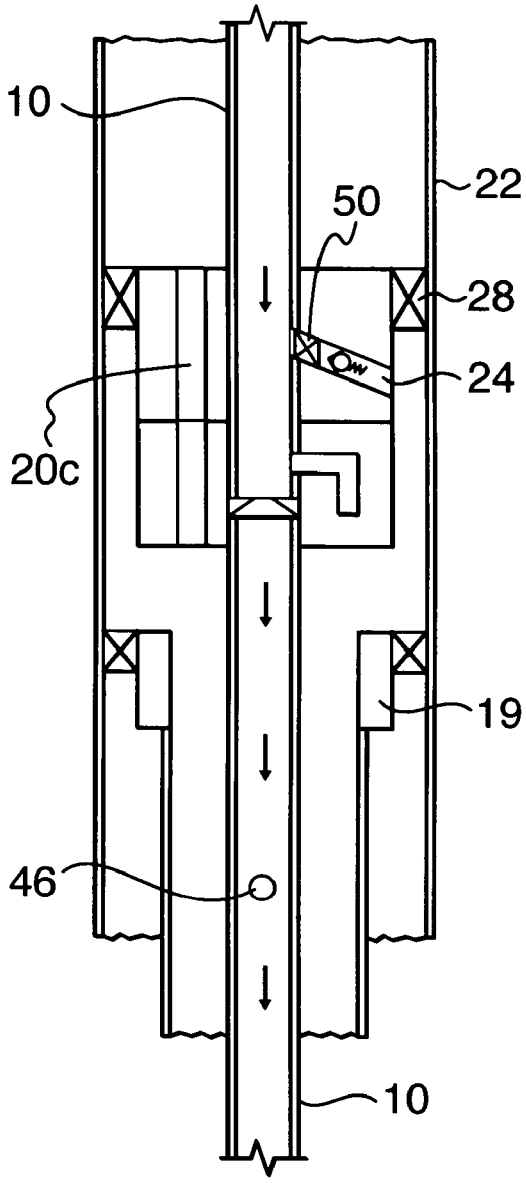
FIG. 6 is a view showing a method that may follow from that of FIG. 5.

After setting liner hanger 19, it may be desirable, as shown in FIG. 6, to resume access through drill string 10 below valve 40. As such it may be desirable to select the valve at ball 46 to be removable by expulsion of the ball downwardly, as shown, by destruction of the ball or of the valve seat or by reverse circulation of the ball to surface.

Figure 7:
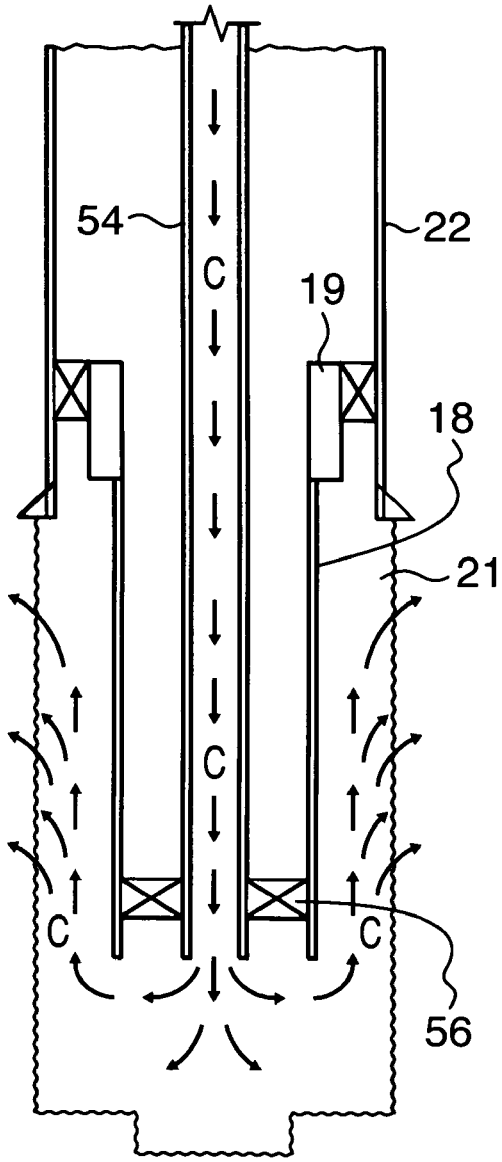
FIG. 7 is a view showing a method that may follow from that of FIG. 6.

Pressuring up, downhole manipulation, such as axial or rotational movement, etc. can be employed to release at least a portion of sub 20*c* from the liner 18 and liner hanger 19. If desired, downhole manipulation, such as axial or rotational movement or abutment of the sub or the drill string, may be useful to compress seal 28, such compression possibly being useful to facilitate pulling the sub and the drill string out of the hole. Such manipulation may be achieved, for example, by setting sub 20*c* down on liner 18 once they have been separated. Once sub 20*c* is released from the liner, it can be tripped with the drill string to surface.

Where it is desired to, thereafter, cement liner 18 in place, a completion string 54 may be run into the hole through casing 22 and liner 18. As shown in FIG. 7, completion string 54 may carry a packer 56 sealable between string 54 and liner 18 such that any cement C conveyed through the string may be directed into annulus 21 between the liner and the borehole wall.

Figure 8:
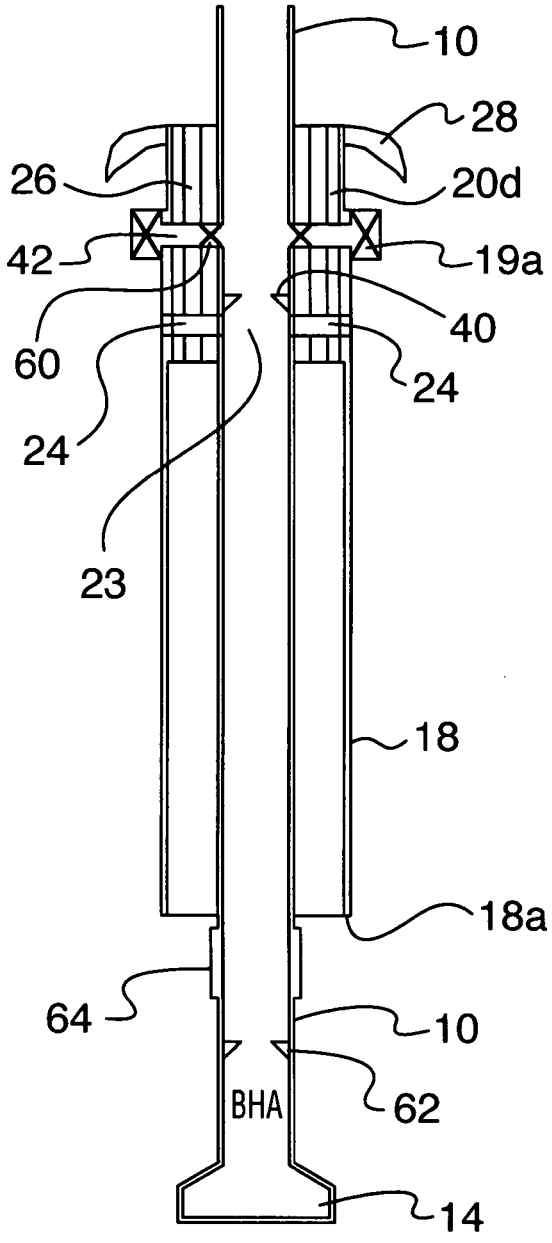
FIG. 8 is a schematic sectional view along a wellbore drilling apparatus.
Figure 9:
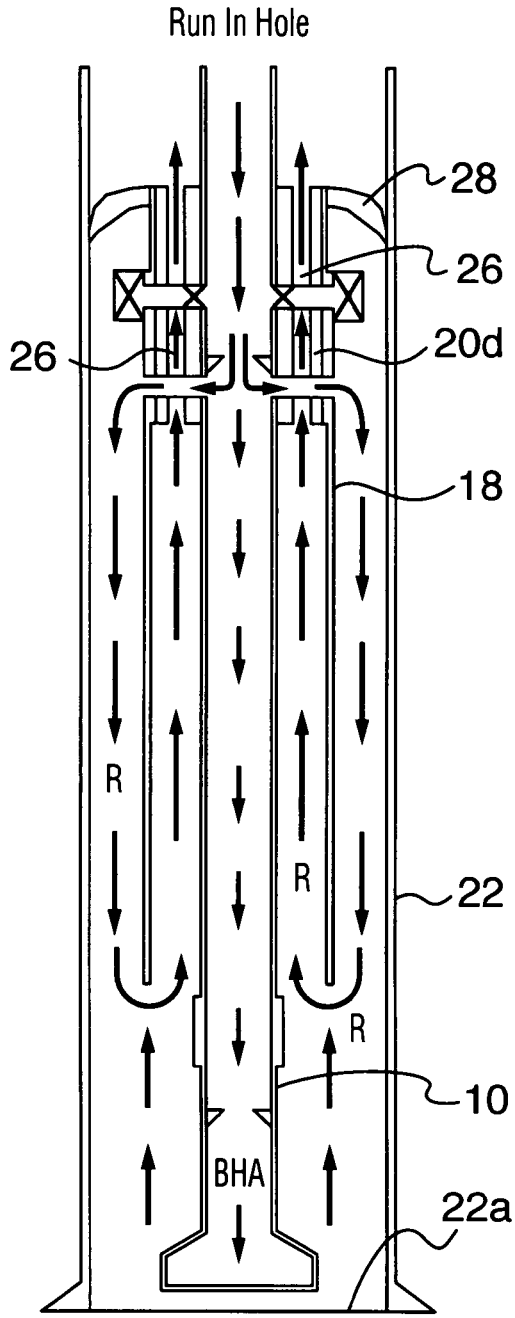
FIG. 9 is a schematic sectional view along a wellbore showing another drilling method employing the apparatus of FIG. 8.

Referring to FIG. 8, in another embodiment a sub 20*d* and other mechanisms may be provided to permit running in, drilling, hanging and cementing the liner in a borehole without tripping of sub 20*d* or the string 10 on which the sub is carried. In such an embodiment, sub 20*d* may include a bore 23 from its upper surface to its lower surface or may accommodate the drill string therethrough. Drill string 10 can be threadedly connected into bore 23 such that the bore provides communication between the drill string inner bore above and below the sub.

A liner 18 may be secured to sub 20*b* to hang down over a length of the drill string with an annulus formed therebetween. An opening is formed by spacing between liner shoe 18*a* and drill string 10 and pilot bit 14 and under reamer 16 (FIG. 10) extend out from the end of the liner. Liner 18 may carry a hydraulically operable liner hanger/packer 19*a*.

Sub 20*d* may include ports 24 open to and extending from bore 23. Ports 24 may be closed by manipulation of the sub relative to the liner. Sub 20*d* may also include ports 26 extending substantially parallel to, but not in communication with, bore 23, and a seal 28 about the sub selected to seal between the sub and a borehole in which the assembly is to be used.

In the embodiment of FIG. 8 the bottom hole assembly may include a pilot bit 14, an underreamer 16, a lower drill string bore valve 62, such as may be provided by a ball catch seat-containing sub and a tubing wall valve 64, such as may be provided by a pump out sub. As will be appreciated, the bottom hole assembly may also include other components such as, for example, a positive displacement motor, mechanisms for MWD/LWD, centralizers, stabilizers, etc.

Sub 20*d* may further include a setting actuation portion for the liner hanger/packer 19*a* that may include, for example, a ball catch valve 40 positioned in bore 23 and including a seat for accepting a ball 46 (FIG. 11) launchable from a position above the valve, fluid passages 42 to hanger/packer 19*a* and at least one valve 60 for closing off each of the passages. Passages 42 may be positioned above port 24 and valve 40 may be positioned between passages 42 and ports 24, so that passages 42 may be hydraulically isolated by valve 40 from ports 24. In this position, ports 24 may also be accessible below hanger/packer 19*a*.

In a liner drilling operation, the assembly of FIG. 8 may be useful to achieve any or all of (i) drilling in the liner, possibly using reverse circulation of drilling fluid, (ii) hanging the liner by, for example, hydraulically setting slips and packing off the annulus, (iii) releasing the liner, (iv) cementing the liner, by introducing cement to the liner-borehole annulus, (v) holding the cement in the annulus until it sets, to avoid U-tubing of cement slurry, and (vi) clearing out cement slurry from the drill string, and possibly portions of the casing and liner.

In particular, with reference to FIGS. 9 to 16, an assembly including sub 20*d*, drill string 10 and liner 18 may be made up and run into a borehole through, for example, a casing 22 already installed and cemented in place. During run in, fluid may be circulated and any returns R displaced by seal 28 may be routed through ports 26. The assembly can be run in until the pilot bit reaches the intermediate casing shoe 22*a*.

Figure 10:
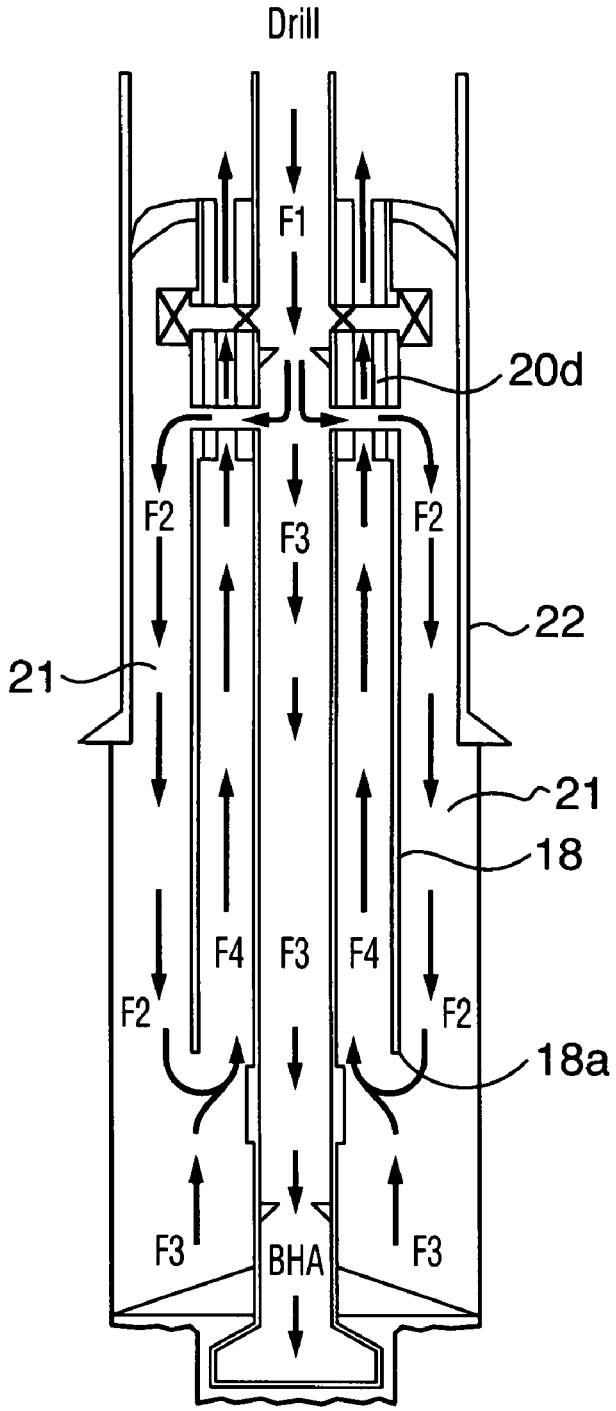
FIG. 10 is a view showing a method that may follow from that of FIG. 9.

At the casing shoe, as shown at FIG. 10, drilling can commence by operation of pilot bit 14 and underreamer 16, wherein the shoe is drilled out and drilling may proceed to liner total depth. In so doing, mud can be pumped F1 down the drill string. A smaller portion, for example in one embodiment about 30%, of the mud can pass F2 through ports 24 and down the liner/borehole annulus 21, while the remainder F3 continues down the string to be jetted through pilot bit 14. Flows F2 and F3 meet at the opening between liner shoe 18*a* and drill string 10 and together return towards surface by flowing F4 up through the string/liner annulus. Seal 28 isolates flow F2 separate from flow F4.

Figure 11:
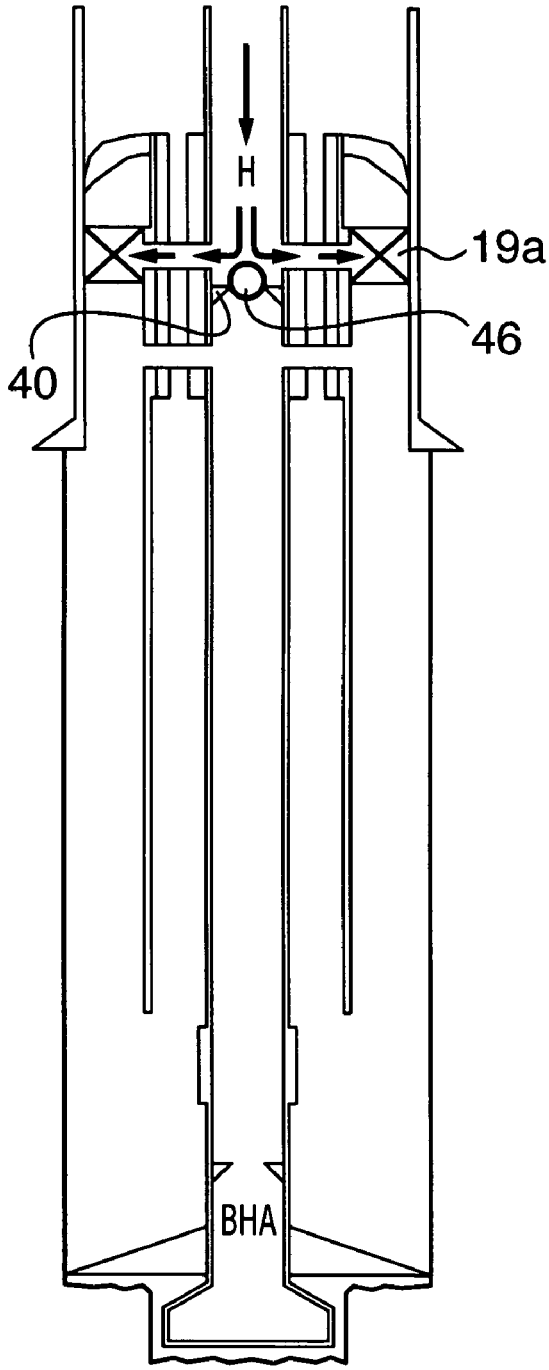
FIG. 11 is a view showing a method that may follow from that of FIG. 10.

At total depth, mud can be circulated to clean the hole that has been drilled. Then, as shown in FIG. 11, ball 46 can be dropped to create a seal at valve 40, so that hanger/packer 19*a* may be hydraulically set H to hang the liner in the borehole.

Figure 12:
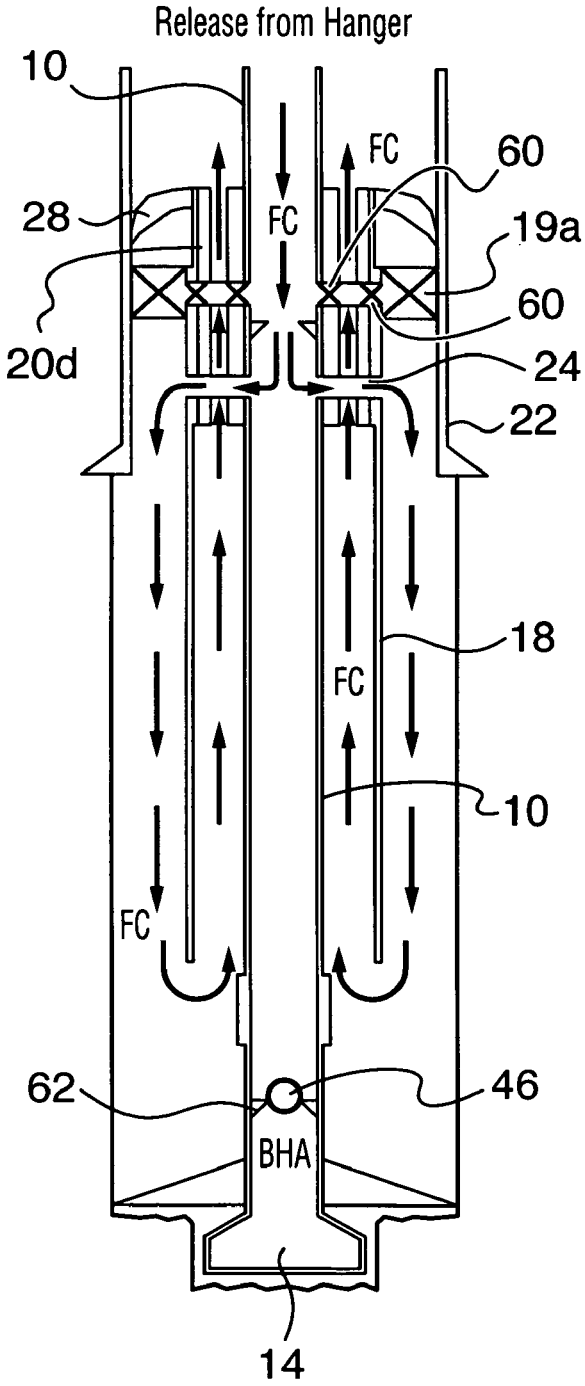
FIG. 12 is a view showing a method that may follow from that of FIG. 11.
Figure 13:
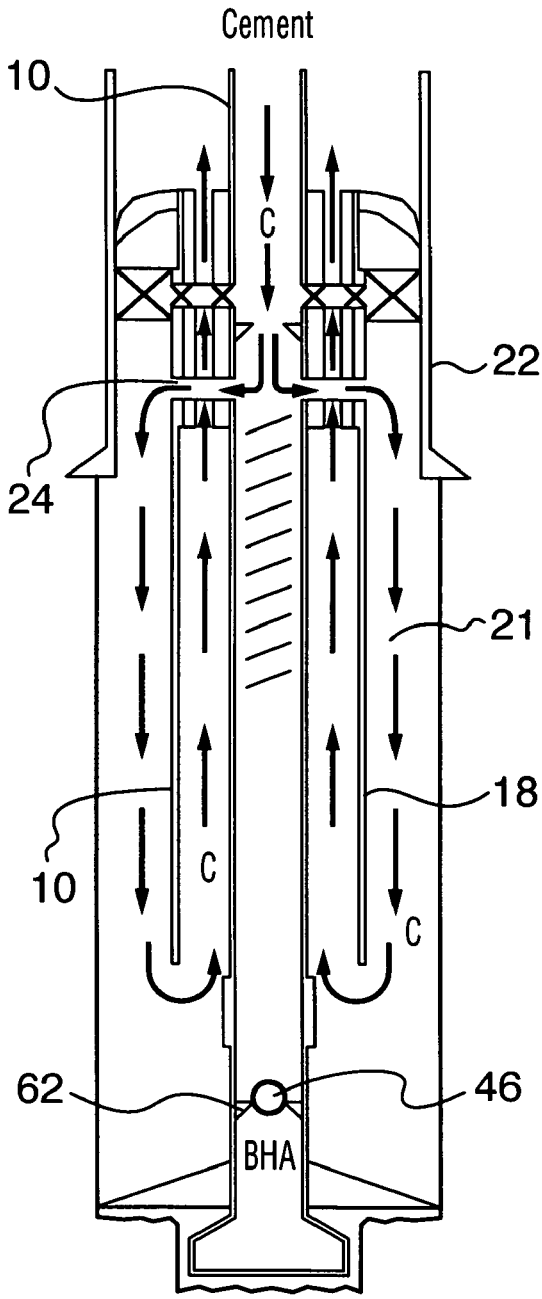
FIG. 13 is a view showing a method that may follow from that of FIG. 12.

With reference to FIG. 12, sub 20*d* may then be disconnected from liner 18, as by application of left hand torque to the drill string, and thereby to sub 20*d*, from surface. The drill string may be hoisted slightly to confirm that the liner has been released from the liner. These manipulations may close valves 60. Fluid pressure may then be increased in drill string such that ball 46 is released and lands in lower drill string bore valve 62 such that flow to pilot bit 14 may be stopped but access to ports 24 is again achieved. Ports 24 may then operate as cementing ports and once circulation is established from surface through ports, a fluid caliper FC can be pumped for cement volume determination.

A spacer and cement slurry C (FIG. 13), as required, can then be pumped down the drill pipe and out through ports 24. Such pumping drives the cement slurry C to be reversed down borehole/liner annulus 21 and up through the liner in the liner/string annulus. Cement pumping can be continued until the cement is displaced to a point above sub 20*d*. In one embodiment, for example, the cement may be displaced to a level about 200 ft. above the sub.

Figure 14:
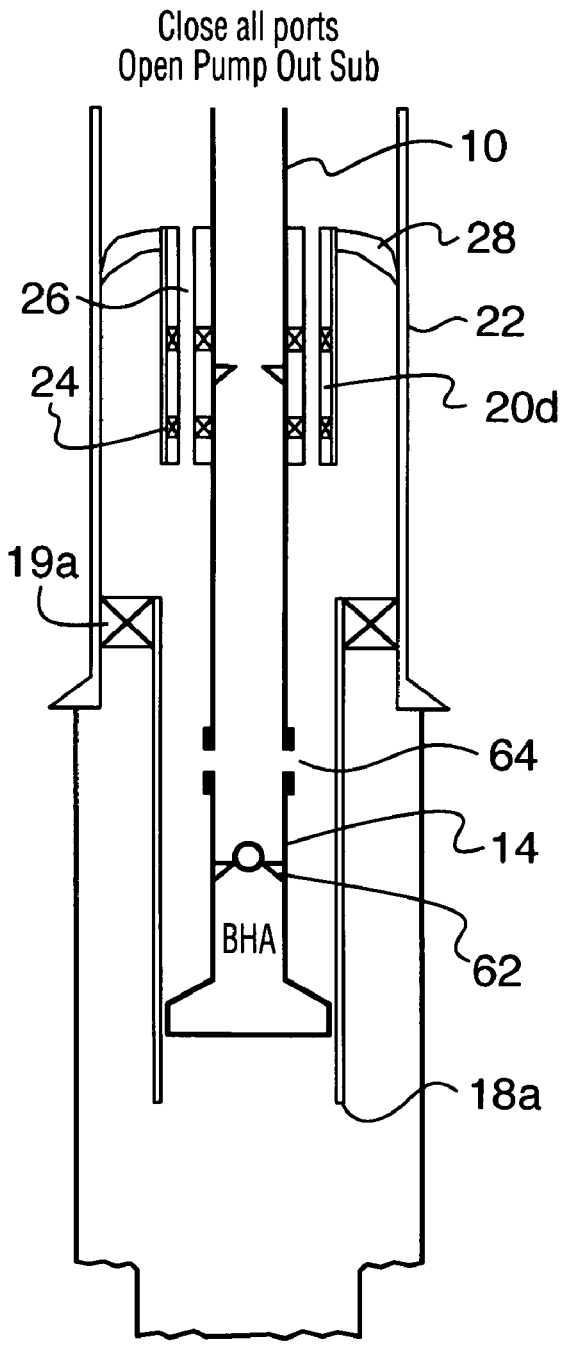
FIG. 14 is a view showing a method that may follow from that of FIG. 13.
Figure 15:
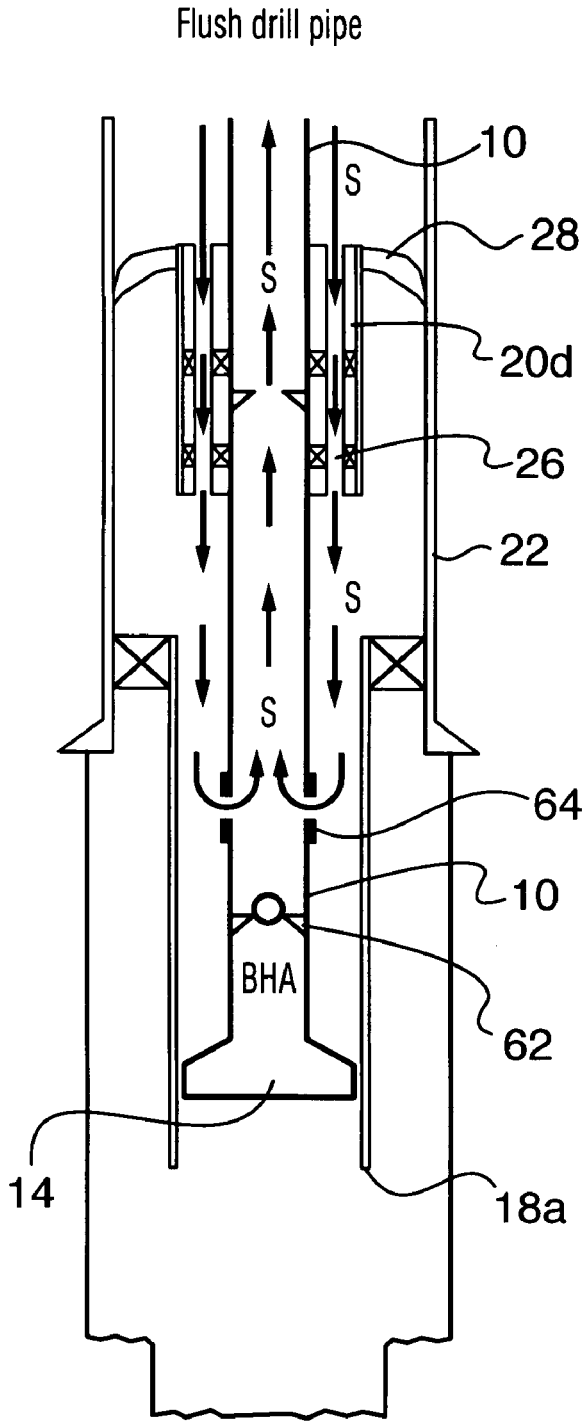
FIG. 15 is a view showing a method that may follow from that of FIG. 14.

As shown in FIG. 14, while the cement remains hydraulic, drill string 10 and sub 20*d* may be hoisted in the liner to elevate the bottom hole assembly to a position above liner shoe 18*a*. In one embodiment, the bottom hole assembly may be spaced at least 500 feet above liner shoe 18*a*. Ports 24 are closed through the sub. Any openings on liner that correspond to ports 24 are also closed. Tubing wall valve 64 may then be opened, as by pressuring up the drill string or by manipulation. To flush cement from the drill pipe, as shown in FIG. 15, fluid may be circulated S through tubing wall valve 64. In the illustrated embodiment, such circulation is conducted in the reverse down through casing 22, through valve 64 and back up through drill string 10.

Figure 16:
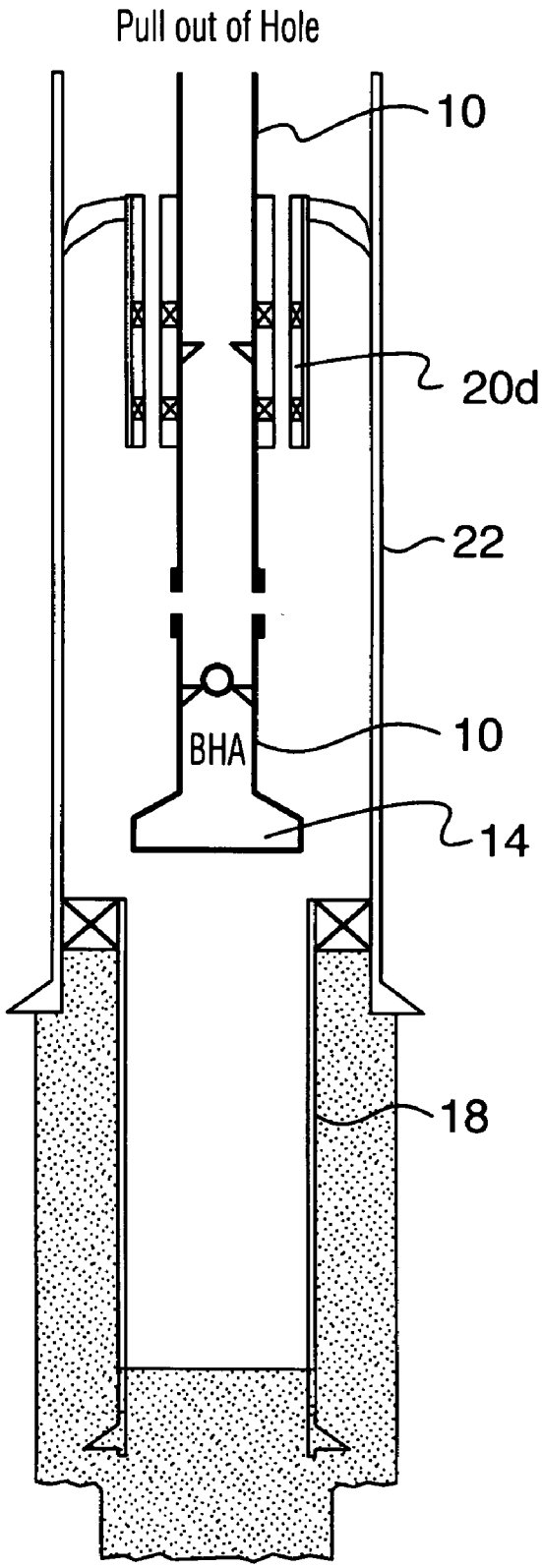
FIG. 16 is a view showing a method that may follow from that of FIG. 15.

Once the cement has set, the drill string and the sub can be hoisted out of the hole, leaving the liner cemented in place. This is shown in FIG. 16.

While the foregoing method may be useful with various sized strings and boreholes and various equipment, in one embodiment according to FIGS. 9 to 16, an 11¾ inch liner may be drilled in, hanged and cemented in a 13⅜ inch casing annulus using a 10⅝ inch pilot bit with a 14 inch cut PDC underreamer, as is available from TESCO Corporation, who is the assignee of the present invention. The pilot bit and underreamer may be driven by a positive displacement motor. Of course, this example is only included for the purpose of illustration and is not intended to be used to limit the invention in any way.

Numerous modifications, variations and adaptations may be made to the particular embodiments described above without departing from the scope of the invention as defined in the claims.

We claim:

1. A borehole drilling apparatus comprising: a drill string including a center bore and a distal end; a bit assembly at the drill string's distal end; a ported sub mounted on the drill string, the ported sub including an upper surface, a lower surface, a bore extending from the upper surface to the lower surface to which the drill string is connected, an axially extending port for providing fluid communication between the lower surface and the upper surface separate from fluid communication with the bore and a lateral port for providing fluid communication between the drill string center bore and an outer surface of the sub between the upper surface and the lower surface, the lateral port being substantially isolated against fluid communication with the axially extending port during operation; and a liner engaging surface encircling the lower surface, the liner engaging surface formed to releasably secure a borehole liner such that the drill string extends through the borehole liner with the bit assembly extending beyond a liner shoe of the liner with an opening between the drill string and the liner.

2. The borehole drilling apparatus as in claim 1 further comprising a seal extending about the sub operable to create a seal between the upper surface and the liner engaging surface.

3. The borehole drilling apparatus as in claim 2 wherein the seal extends about the ported sub to be operable to seal against fluid communication between the axially extending port and the lateral port.

4. The borehole drilling apparatus as in claim 3 wherein the lateral port opens between the liner engaging surface and the seal.

5. The borehole drilling apparatus as in claim 3 wherein the lateral port opens at the liner engaging surface.

6. The borehole drilling apparatus as in claim 1 wherein the lateral port opens at the liner engaging surface.

7. The borehole drilling apparatus as in claim 1 wherein the lateral port has a flow volume less than that of the bore such that a lesser fluid flow volume passes through the lateral port than the bore.

8. The borehole drilling apparatus as in claim 1 further comprising a valve to control fluid flow through the lateral port.

9. The borehole drilling apparatus as in claim 1 wherein the sub further includes a passage opening from the drill string center bore to provide fluid communication with a liner hanger setting component.

10. The borehole drilling apparatus as in claim 9 wherein the liner hanger setting component is integral with the sub.

11. The borehole drilling apparatus as in claim 9 wherein the sub further includes a valve in the bore, which is closeable to divert fluid pressure to the liner hanger setting component.

12. An apparatus for drilling a borehole defined by a borehole wall, the apparatus comprising: a drill string including a center bore and a distal end; a bit assembly at the drill string's distal end; a liner including an upper end and an inner bore and the liner being arranged with the drill string extending through the liner inner bore; a ported sub mounted between the drill string and the liner to support the liner on the drill string, the ported sub including an upper surface, a lower surface about which the liner is connected, a bore extending from the upper surface to the lower surface through which the drill string is connected to the ported sub, an axially extending port for providing fluid communication between the liner inner bore and an upper opening to the upper surface of the sub, a lateral port providing fluid communication between the drill string center bore and an outer surface of the sub between the upper surface and the lower surface, the lateral port being substantially isolated against fluid communication with the axially extending port during operation; and a seal adjacent the upper end of the liner and selected to seal against fluid flow upwardly about the liner upper end from an annulus formed between the liner and the borehole wall.

13. The apparatus of claim 12 wherein the drill string is connected by threaded connections into the bore of the ported sub.

14. The apparatus of claim 12 wherein the seal extends about the ported sub to seal about the ported sub against fluid communication between the axially extending port and the lateral port.

15. The apparatus as in claim 12 wherein the lateral port has a flow volume less than that of the bore such that a lesser fluid flow volume passes through the lateral port than the bore.

16. The apparatus as in claim 12 further comprising a valve to control fluid flow through the lateral port.

17. The apparatus as in claim 12 wherein the sub further includes a passage opening from the drill string center bore to provide fluid communication with a liner hanger setting component.

18. The apparatus as in claim 17 wherein the liner hanger setting component is integral with the sub.

19. The apparatus as in claim 17 wherein the sub further includes a valve in the bore, which is closeable to divert fluid pressure to the liner hanger setting component.

20. The apparatus as in claim 19 wherein the valve includes a seat to be sealed by a ball launchable from above the valve and the ball and seat are selected to be selectively openable to reopen the bore.

21. The apparatus as in claim 19 wherein the passage is positioned above the valve and the valve is positioned above the lateral port.

22. The apparatus of claim 12 wherein the seal is mounted on the ported sub.

23. The apparatus of claim 12 wherein the seal is mounted about the liner.

24. The apparatus of claim 12 further comprising a drill string bore valve in the drill string between the ported sub and the bit assembly.

25. The apparatus of claim 12 further comprising a tubing wall valve openable to form an opening through the drill string wall between the ported sub and the bit assembly.

26. A method for drilling a borehole comprising: providing a drill string of including a center bore, a distal end, a bit assembly at the distal end; hanging a liner from the drill string, thereby forming an annular space between the drill string and the liner and with the bit assembly extending from a lower end of the liner; positioning the drill string with the liner attached thereto in a borehole such that a second annular space is formed between the liner and the borehole wall; operating the bit assembly to proceed with drilling the borehole; and circulating drilling fluid down through the center bore of the drill string out through the bit assembly and down through the second annular space between the liner and the borehole wall, the drilling fluid returning up through the annular space between the drill string and the liner.

27. The method of claim 26 wherein the drilling fluid is circulated down through the second annular space from a port extending from the drill string that opens into the second annular space.

28. The method of claim 26 wherein after a selected depth is reached, the method further comprises hanging the liner in the borehole, disconnecting the drill string from the liner and pulling the drill string to surface, leaving the liner in the borehole.

29. The method of claim 28 the method further comprising inserting a cementing string and pumping cement through the cementing string to fill the second annular space.

30. The method of claim 26 wherein after a selected depth is reached, the method further comprises pumping cement down through the second annular space and up through the annular space between the drill string and the liner.

31. The method of claim 30 further comprising hoisting the drill string such that the bit assembly is positioned above the liner shoe and circulating fluid through the drill string to clear cement from the drill string.

32. The method of claim 26 further comprising providing a ported sub mounted on the drill string, the ported sub including an upper surface, a lower surface, a bore extending from the upper surface to the lower surface to which the drill string is connected such that the bore is in communication with the drill string center bore, an axially extending port for providing fluid communication between the lower surface and the upper surface but isolated from fluid communication with the bore; and a liner engaging surface encircling the lower surface, the liner engaging surface formed to releasably engage the liner for hanging on the drill string.

* * * * *